US010414202B2

(12) United States Patent
Chen et al.

(10) Patent No.: US 10,414,202 B2
(45) Date of Patent: Sep. 17, 2019

(54) MULTI-PURPOSE COMBINATION WRITING INSTRUMENT

(71) Applicant: Pengea Inc., Brooklyn, NY (US)

(72) Inventors: Jason Chen, Brooklyn, NY (US); Richard Mark, New York, NY (US)

(73) Assignee: Pengea Inc., Brooklyn, NY (US)

( * ) Notice: Subject to any disclaimer, the term of this patent is extended or adjusted under 35 U.S.C. 154(b) by 173 days.

(21) Appl. No.: 15/329,708

(22) PCT Filed: Jul. 29, 2015

(86) PCT No.: PCT/US2015/042575
§ 371 (c)(1),
(2) Date: Jan. 27, 2017

(87) PCT Pub. No.: WO2016/018976
PCT Pub. Date: Feb. 4, 2016

(65) Prior Publication Data

US 2017/0239976 A1 Aug. 24, 2017

Related U.S. Application Data

(60) Provisional application No. 62/030,658, filed on Jul. 30, 2014, provisional application No. 62/036,728,
(Continued)

(51) Int. Cl.
*B43K 23/06* (2006.01)
*B43K 7/00* (2006.01)
*B43K 29/007* (2006.01)

(52) U.S. Cl.
CPC ..... *B43K 23/06* (2013.01); *B43K 7/005* (2013.01); *B43K 29/007* (2013.01)

(58) Field of Classification Search
CPC ..... B43K 23/06; B43K 29/007; B43K 29/12; B43K 29/20; B42D 19/00; G09F 11/21; G09F 15/0062; G09F 19/06; A45C 11/34
(Continued)

(56) References Cited

U.S. PATENT DOCUMENTS 2,005,110 A * 6/1935 Ritzert ..... B43K 29/12 206/225
2,301,364 A * 11/1942 Bruck ..... B43K 29/12 235/64
(Continued)

FOREIGN PATENT DOCUMENTS

CN 2055444 U 4/1990
CN 2181402 Y 11/1994
(Continued)

OTHER PUBLICATIONS

Chinese Office Action received in Chinese Application No. 201580038734.1 dated Jan. 26, 2018, pp. 20.
(Continued)

*Primary Examiner* — David P Angwin
*Assistant Examiner* — Bradley S Oliver
(74) *Attorney, Agent, or Firm* — Liang & Frank, LLP; Stanley D. Liang

(57) ABSTRACT

A multi-purpose combination writing instrument is provided. The instrument can comprise a writing instrument holder, with 2 casing members connected together by a retractable unwinding tool. The retractable unwinding tool can be automatically retractable. One or more removable individual writing instruments can be reversibly attached to the writing instrument holder. An individual writing instrument is provided that comprises a male connector adapted to be mated to a corresponding female connector or that comprises an external screw thread. A casing member of a
(Continued)

writing instrument holder is provided, comprising an automatic retracting mechanism stored in the casing member and adapted to be attached to a retractable unwinding tool and adapted to allow the retractable unwinding tool to automatically retract. Another multi-purpose combination writing instrument is provided, comprising a writing instrument holder that is fan-shaped (like a hand-held fan). Yet another multi-purpose combination writing instrument is provided, comprising a writing instrument holder comprising zero, one, or two casing members comprising a hinge assembly, which comprises a hinge.

5 Claims, 4 Drawing Sheets

Related U.S. Application Data filed on Aug. 13, 2014, provisional application No. 62/111,846, filed on Feb. 4, 2015.

(58) Field of Classification Search
USPC ..... 40/117, 518
See application file for complete search history.

(56) References Cited

U.S. PATENT DOCUMENTS

| | | | | | |
|---|---|---|---|---|---|
| 4,603,993 | A * | 8/1986 | Jung | B43K 29/12 | 40/334 |
| 4,646,453 | A * | 3/1987 | Reinhart | G09D 3/10 | 40/117 |
| 5,605,001 | A * | 2/1997 | Derk | G09F 11/21 | 40/117 |
| 6,719,472 | B2 * | 4/2004 | Windorski | B43K 29/12 | 401/195 |
| 6,905,275 | B1 * | 6/2005 | Del Valle | B43K 23/126 | 401/195 |
| 7,168,105 | B2 * | 1/2007 | Adelman | B43K 5/005 | 401/195 |
| 8,016,506 | B2 * | 9/2011 | Adamberry | B43K 29/001 | 401/195 |
| 9,022,677 | B1 * | 5/2015 | Hughes | B43K 23/126 | 401/195 |
| 9,659,512 | B2 * | 5/2017 | Lee | G09F 15/0062 | |
| 2005/0100393 | A1 | 5/2005 | Lin | | |
| 2006/0165470 | A1 * | 7/2006 | Gerules | B43K 23/06 | 401/18 |
| 2008/0226378 | A1 * | 9/2008 | Sheu | B43K 21/006 | 401/18 |
| 2017/0087922 | A1 * | 3/2017 | Dorpmund | B43K 29/05 | |

FOREIGN PATENT DOCUMENTS

| | | | | |
|---|---|---|---|---|
| CN | 2424936 | Y | 3/2001 | |
| CN | 2763054 | Y | 3/2006 | |
| CN | 2902746 | Y | 5/2007 | |
| CN | 200967321 | Y | 10/2007 | |
| CN | 201296105 | Y | 8/2009 | |
| CN | 201362080 | Y | 12/2009 | |
| CN | 203126228 | U | 8/2013 | |
| DE | 9101160 | U1 | 6/1991 | |
| EP | 2039528 | A2 | 3/2009 | |
| EP | 2436531 | A1 * | 4/2012 | B42D 5/006 |
| JP | T1418239 | Y | 12/1925 | |
| JP | S57118886 | U | 7/1982 | |
| JP | S57138674 | U | 8/1982 | |
| JP | S57193583 | U | 12/1982 | |
| JP | H2111589 | U | 9/1990 | |
| JP | 2006321131 | A | 11/2006 | |
| JP | 2010179540 | A | 8/2010 | |
| WO | 2004103725 | A1 | 12/2004 | |

OTHER PUBLICATIONS

Japanese Application No. 2017-526046, Office Action dated Feb. 26, 2019, 7 pages.

* cited by examiner

MULTI-PURPOSE COMBINATION WRITING INSTRUMENT

TECHNICAL FIELD OF THE INVENTION

This invention relates to the stationary field.

BACKGROUND

Generally, people use multiple, individual writing instruments. These instruments include pens, pencils, and highlighters, and are usually sold and used as separate units. But when one is using one individual writing instrument and needing additional individual writing instruments, it may require that one searches for the additional writing instruments, swaps instruments, and/or shifts hands, thereby wasting time and causing frustration.

SUMMARY OF THE INVENTION

This invention solves the problem discussed above by providing a single writing instrument that is a multi-purpose combination writing instrument.

In certain aspects, this multi-purpose combination writing instrument comprises a writing instrument holder. The instrument holder comprises 2 casing members connected together by a retractable unwinding tool. The retractable unwinding tool can be automatically retractable. One or both sides of the surfaces of the retractable unwinding tool can have on it a design, such as a logo, a popup, artwork, literature, or a hologram. The logo can be any logo. Each side can have something different or the same (i.e., the same logo, different logos, a logo and a popup, etc.). Between 1-4 (1, 2, 3, or 4) individual writing instruments can be removably attached to the writing instrument holder. The individual writing instrument can be retractable or capped.

In another aspect, this invention provides an individual writing instrument. In certain embodiments, the individual writing instrument comprises a male connector that is adapted to be mated to a corresponding female connector, or vice versa. In other embodiments, the individual writing instrument comprises an external screw thread. The individual writing instrument can be between about 3 inches to about 4 inches long.

In yet another aspect, this invention provides a casing member of a writing instrument holder comprising an automatic retracting mechanism stored in the casing member and adapted to be connected to a retractable unwinding tool and adapted to allow the retractable unwinding tool to automatically retract.

In another aspect, this invention provides a multi-purpose combination writing instrument comprising a writing instrument holder, which comprises a retractable unwinding tool that is shaped like a hand-held fan (i.e., unwinds and retracts like a hand-held fan and looks like a hand-held fan) and comprises two casing members held together by the retractable unwinding tool. The writing instrument holder is shaped like a hand-held fan.

In another aspect, this invention provides a multi-purpose combination writing instrument comprising a writing instrument holder, which comprises zero, one, or two casing members with optionally a hinge assembly comprising a hinge assembled at around the middle of the writing instrument holder.

Numerous other aspects are provided in accordance with these and other aspects of the invention. Other features and aspects of the present invention will become more fully apparent from the following detailed description, the appended claims and the accompanying drawings.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION OF THE INVENTION

Figure 1:
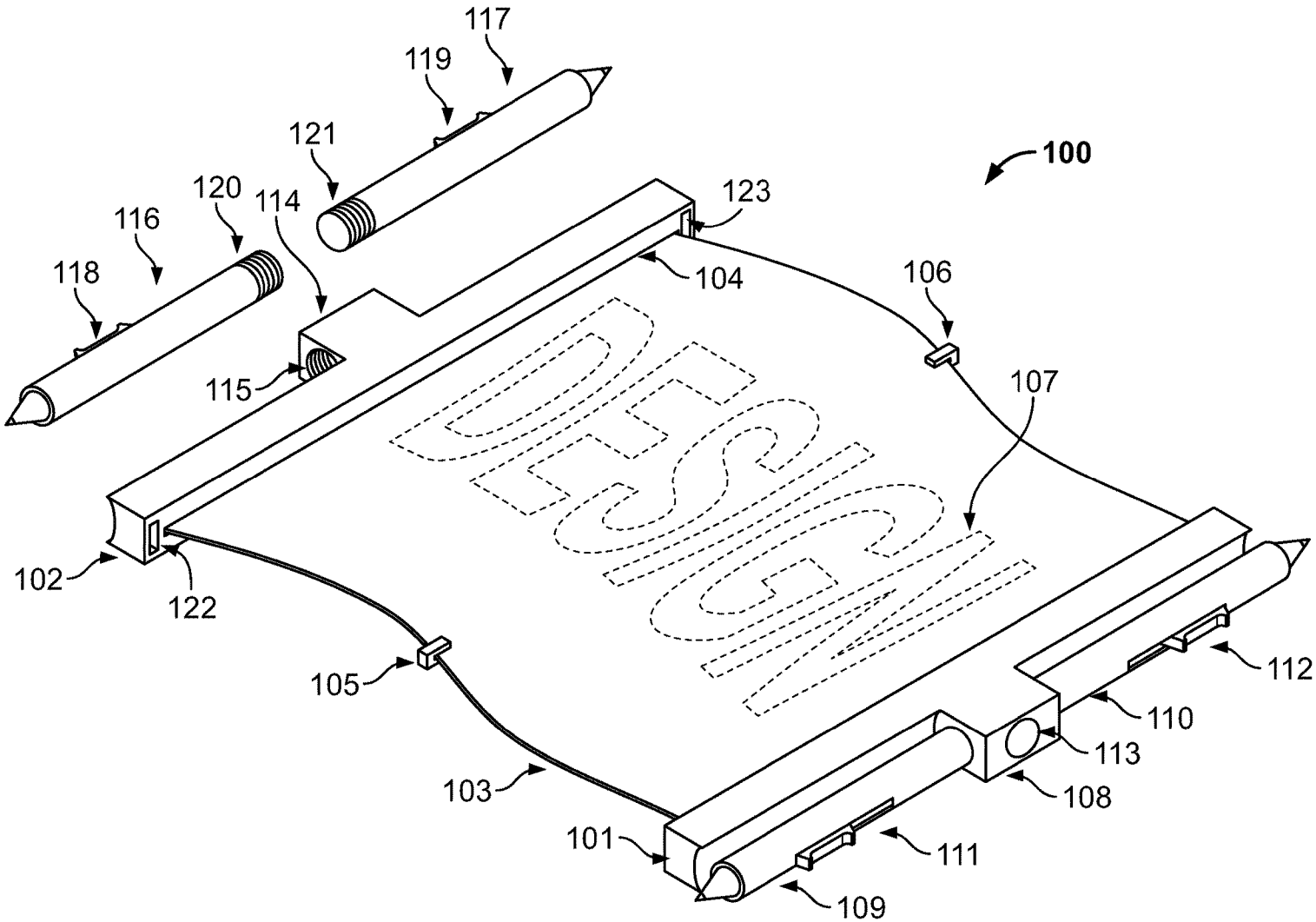
FIG. 1 is a schematic view of a multi-purpose combination writing instrument, comprising a writing instrument holder, which comprises two casing members connected laterally by a retractable unwinding tool, according to embodiments of the present invention.

This invention has the advantage of allowing the user to carry one multi-purpose combination writing instrument with multiple purposes rather than several individual writing instruments, each having only a single purpose.

For example, this invention provides a multi-purpose combination writing instrument that can have 6 to 8 allotted spots for various writing tools, such as individual writing instruments and tape flags. This multi-purpose combination writing instrument can contain, for example, 2 colors of pens, 2 colors of highlighters, and 2 to 4 colors of tape flags all within one device. The user can assemble a different mix of writing tools according to the user's preference. Because of its many functions, it is also a time saving writing device meeting the needs of the user (such as a student or a professional). It is also easy to replace the individual tools.

In one aspect, this invention provides a multi-purpose combination writing instrument, which comprises a writing instrument holder. The instrument holder can be of any size. In some embodiments, the instrument holder is between about 6, about 7, to about 8 inches long. In some embodiments, the instrument holder is between about 1, about 2, about 3, about 4, to about 5 inches wide. Other sizes are also contemplated.

In certain aspects, the writing instrument holder comprises two casing members connected together laterally by a retractable unwinding tool, which can be like a scroll, and which can be laminated. The retractable unwinding tool can be flexible and/or bendable. The retractable unwinding tool is located inside one or both the casing members when the retractable unwinding tool is retracted. In certain embodiments, the retractable unwinding tool is located inside one of the two casing members. The retractable unwinding tool can be retracted into one or both of the casing members. Each casing member has an opening facing the retractable unwinding tool; the opening being long and wide enough to allow passage of the retractable unwinding tool into the casing member(s). The two openings face each other. The retractable unwinding tool can be fully retracted or can be partially or completely open (i.e., not retracted). In certain embodiments, the casing members are rectangular. But the casing members can be any suitable shape.

In certain embodiments, the casing members are rectangular and the rectangular casing members have rounded edges from the top to the bottom of the casing members on the outside of each casing member distally from the other casing member and distally from the retractable unwinding tool when the tool is not retracted (also referred to hereinafter as "rounded edges"); the top and bottom of each casing member facing each other (i.e., proximal to each other) remain rectangular, allowing the two casing members to fit snugly with one another when the retractable unwinding tool is retracted. Other shapes are also contemplated for the casing member.

In certain embodiments, the casing members can be between about 6, about 7, about 8, to about 9 inches long, but can be of any suitable size. The casing members can be made by plastic that is molded, or other suitable material(s) known in the art and by any conventional means.

In certain embodiments, each casing member comprises a lock at each end, on the top and the bottom of the casing member in a symmetrical fashion, facing the other casing member, the lock being adapted to lock the two casing members together when the retractable unwinding tool is retracted. In certain embodiments, the locks can be magnets. In certain embodiments, one lock in one casing member on the top or the bottom of a casing member has a female part while the corresponding lock on the other casing member has a male lock part on the corresponding location (top and/or bottom).

In certain embodiments, the casing members are made of molded plastic and are optionally rectangular with rounded edges. A rectangular casing member, with or without rounded edges, has a top and a bottom. In certain embodiments, a small protrusion member, which can be any size, including between about 0.5, about 1, about 1.5, to about 2 inches long, and any anything in between, is molded together with each casing member laterally at about the middle of the casing member facing distally from the retractable unwinding tool when the retractable unwinding tool is not retracted. The protrusion member can be made of any suitable material(s) by any conventional method. In certain embodiments, the protrusion member is made of molded plastic. In certain embodiments, the individual writing instrument is retractable and the individual writing instrument comprises a side knob for retracting the individual writing instrument. The side knob allows the "business end" of the writing instrument, such as the writing end of a pen, an eraser, etc., to be propelled forwardly by the simple inward pressure of the user's forefinger and/or thumb on the knob allowing the pen cartridge or the like (depending on the instrument) to be in a writing position or retracted into an inactive position. See, e.g., U.S. Pat. No. 4,381,158. The protrusion member can be of any suitable shape. In certain further embodiments, the protrusion member comprises 2 internal screw threads placed at each end of the protrusion member parallel to the casing member, and pointing in opposite directions, each screw thread adapted to receive an individual writing instrument comprising an external screw thread, each individual writing instrument being screwed into the protrusion member such that the individual writing instruments are in opposite orientation to each other, such that the multi-purpose combination writing instrument comprises four individual writing instruments. In yet other further embodiments, the protrusion member comprises 2 female connectors placed at each end of the protrusion member parallel to the casing member, and pointing in opposite directions, each female connector adapted to receive an individual writing instrument comprising a male connector that is adapted to be mated to the female connector, each individual writing instrument being connected to the protrusion member by the male/female connectors such that the two individual writing instruments are in opposite orientation to each other, such that the multi-purpose combination writing instrument comprises four individual writing instruments. The female connector can also be on the individual writing instrument and the male connector being on the casing member. Any type of fasteners, or the like, as well as other means known in the art to join two such objects together, can be used that allows the protrusion member to be adapted to receive an individual writing instrument so that the individual writing instrument is removably tethered to the protrusion member. In certain embodiments, the individual writing instrument is connected to the combination multi-purpose writing instrument, such as to a protrusion member, by friction fit, in which the friction material is made of thermoplastic elastomer ("TPE") and this rubber is injected over the hard plastic. The rubber can be in the form of a circle or a partial circle. The fit can be calibrated for optimal plug-in and removal effort.

In certain embodiments, tape flag dispensers, which can contain round flags (any other shapes are also contemplated), are attached reversibly, by, for example, glue, to the outside of the protrusion member, or to another suitable part of the writing instrument.

In some embodiments, the casing members are made of molded plastic and are optionally rectangular with rounded edges. In certain embodiments, an outer second casing member, located laterally to the first casing member and facing distally from the retractable unwinding tool when it is not retracted, can be made of molded plastic, and can be molded together with each of the first casing members. The outer second casing member can be cylindrical, partially cylindrical, the same or different length than the first casing member, and can be a clip. In yet certain further embodiments, each of these outer second casing members comprises 2 internal screw threads placed at about the midpoint of the second casing members, each screw thread adapted to receive an individual writing instrument comprising an external screw thread, wherein each individual writing instrument is placed inside the outer second casing member and screwed into the outer second casing member such that the individual writing instruments are in opposite orientation to each other inside the outer second casing member, such that the multi-purpose combination writing instrument comprises four individual writing instruments. In yet other further embodiments, each of these outer second casing members comprises 2 internal female connectors placed at about the midpoint of the outer second casing member, each female connector adapted to receive an individual writing instrument comprising a male connector that is adapted to be mated to the female connector, wherein each individual writing instrument is placed inside the outer second casing member and connected by the male/female connector into the outer second casing member such that the individual writing instruments are in opposite orientation to each other; such that the multi-purpose combination writing instrument comprises four individual writing instruments. The female connector can also be on the individual writing instrument and the male connector being on the casing member. Any type of fasteners, or the like, as well as other means known in the art to join two such objects together, can be used that allows the outer second casing member to be adapted to receive an individual writing instrument so that the individual writing instrument is removably tethered to the outer second casing member. In certain embodiments, the outer second casing member is a clip that is adapted to receive one or more individual writing instruments. In certain embodiments, the individual writing instrument is connected to the writing instrument, such as to an outer second casing member, by friction fit, in which the friction material is made of thermoplastic elastomer ("TPE") and this rubber is injected over the hard plastic. The rubber can be in the form of a circle or a partial circle. The fit can be calibrated for optimal plug-in and removal effort.

In certain embodiments, the retractable unwinding tool, which can be like a scroll, can be made of fabric or other suitable material(s), and can be laminated. In certain embodiments, the retractable unwinding tool is flexible and/or bendable. In certain embodiments, the retractable unwinding tool is between about 6, about 7, about 8, about 9, about 10, about 11, to about 12 inches wide (measured between the two casing members when fully open, i.e., not retracted). In certain further embodiments, the retractable unwinding tool is between about 4, about 5, about 6, about 7, to about 8 inches wide (measured between the two casing members when fully open, i.e., not retracted). In certain embodiments, the retractable unwinding tool is between about 4 to about 8 inches long (measured as the measurement parallel to a casing member). The retractable unwinding tool can be any suitable size, thickness, length, and width.

In certain aspects, this invention provides a multi-purpose combination writing instrument comprising a writing instrument holder and one or more individual writing instruments. One or more individual writing instruments, numbering between 1-4, for example, can be reversibly attached to the writing instrument holder. In certain embodiments, the individual writing instrument is retractable. Examples of an individual writing instrument include a pen (both fountain pen and ballpoint pen), which can be made of any material(s) (for example, metal), which could be of any color of ink, a pencil, a ruler, a highlighter, which could be of any color, a compass, a stylus for a tablet computer, an eraser for a pencil or for a pen (the eraser can be one that is retractable), a flashlight, and an instrument with whiteout. In certain embodiments, the individual writing instrument is a pen, which can comprise a replaceable ink cartridge. The individual writing instruments can be of any size. In certain embodiments, the individual writing instrument is between about 3 inches to about 4 inches long. In some embodiments, four individual writing instruments are removably attached to the multi-purpose combination writing instrument holder of this invention. The individual writing instruments can be exchanged with ease and can be used either while on the instrument or when removed/detached. An individual writing instrument can also be discarded and replaced with another one. An individual writing instrument can have a barrel, which can have grips on its barrel. In some embodiments, the individual writing instrument further comprises a clip. In certain embodiments, the individual writing instrument is not retractable and can further comprise a cap.

In certain embodiments, tape flag dispensers, which are another writing tool, which can contain round flags (other shapes are also contemplated), are attached reversibly, by, for example, glue, to the outside of the protrusion member or the hinge assembly, or any suitable part of the multi-purpose writing instrument. In certain embodiments, the tape flag dispensers face distally from the unwinding tool when it is not retracted; in certain other embodiments, the tape flag dispensers are located on the front and/or back of the protrusion member or the hinge assembly, parallel to the unwinding tool when it is not retracted. The flags can be positioned vertically on the scroll or on the fan protrusion. The flags can be positioned horizontally on the casing member or the protrusion member. There can be 4 indents on each dispenser to secure the flags and to prevent the flags from falling off the instrument. In certain embodiments, tape flag dispensers are attached to the writing instrument holder. The tape flag dispensers can be removably attached to the writing instrument holder. In certain embodiments, the tape flag dispensers are molded onto the casing member. In certain embodiments, the tape flag dispensers are a set of stickers that can be glued onto the protrusion member or the casing member, which can indent inward towards the casing member. The stickers can supply a set of tape flags. One or more flag dispensers can be located on any suitable part of the writing instrument.

In certain embodiments, the retractable unwinding tool is automatically retractable. In certain embodiments, the two casing members are outside of the retractable unwinding tool (with the retractable unwinding tool stored inside of one or both of the casing members). In certain embodiments, an automatic retracting mechanism comprising a windup spring, a slotted post, and a spring anchor or the like, said mechanism adapted to automatically retract the retractable unwinding tool is attached to the retractable unwinding tool, such that when the retractable unwinding tool is retracted, it is stored inside one or both of the casing members. In some embodiments, the automatic retracting mechanism is like ones that are commonly used for retractable measuring tapes, such as, for example, those disclosed in U.S. Pat. No. 3,713,603, or for retractable crowd control barriers, such as, for example, those disclosed in U.S. Pat. No. 4,844,420. Thus, briefly, in certain embodiments, the automatic retracting mechanism comprises a windup spring inside one or both of the casing members, with a resilient retractable unwinding tool member attached to the spring extending through an opening in the casing member. A stationary device on the casing member provides a passage to admit an extended portion of the retractable unwinding tool laterally into the opening of the casing member. The innermost end of the retractable unwinding tool is riveted or otherwise secured to the outermost end of a windup coil spring whose innermost end is sharply bent for retention in a slotted post integral with the casing member, and can be further retained in a spring anchor or the like. The slotted post can be further enclosed by end caps within the casing member. In certain embodiments, the automatic retraction mechanism enclosed in the casing member(s) is a preloaded tension spring mechanism and/or a tape measure retraction mechanism. The tension spring can be enclosed in a circular tube, which is then fastened with the unwinding tool by tape, glue, or a vertical slot.

In certain embodiments, the retractable unwinding tool that is automatically retractable further comprises two stoppers, one on top and one on the bottom in a symmetrical fashion, at about the middle of the retractable unwinding tool. The stoppers are intended to stop the retractable unwinding tool from disproportionate entry into the casing members.

In certain embodiments, the surface of one or both sides of the retractable unwinding tool has a design, such as a logo, a work of art, a piece of literature, a popup, or a hologram. Each side of the retractable unwinding tool can have the same or different design (or no design). The design can, for example, refer to or relate to technology, cosmetics, renewable energy, sports, etc. The retractable unwinding tool can be of any color(s) and of any suitable size. The design can be placed on a piece of fabric or a sticker that is placed over the surface of the retractable unwinding tool.

This invention provides an individual writing instrument comprising a male connector or a female connector that is adapted to be mated to a corresponding female or male connector. For example, in certain embodiments, the individual writing instrument is adapted to be connected to the multi-purpose writing instrument of this invention by friction fit, in which the friction material is made of thermoplastic elastomer ("TPE") and this rubber is injected over the hard plastic. The rubber can be in the form of a circle or a partial circle. The fit can be calibrated for optimal plug-in and removal effort.

In certain embodiments, the individual writing instrument is between about 3 to about 4 inches long. The individual writing instrument can have a barrel and grips can be on part of the barrel of the instrument. In some embodiments, the individual writing instrument (or a casing member) further comprises a clip adapted for clipping the individual writing instrument onto, for example, a pocket of a shirt. In certain embodiments, the individual writing instrument is not retractable and can further comprise a cap. These individual writing instruments can be part of the multi-purpose combination writing instrument of this invention.

This invention also provides an individual writing instrument comprising an external screw thread. In certain embodiments, the individual writing instrument is between about 3 inches to about 4 inches long. The individual writing instrument can have a barrel and grips can be on part of the barrel of the instrument. In some embodiments, the individual writing instrument further comprises a clip. In certain embodiments, the individual writing instrument is not retractable and can further comprise a cap. These individual writing instruments can be part of the multi-purpose combination writing instrument of this invention.

This invention also provides a casing member of a writing instrument holder of this invention comprising an automatic retracting mechanism stored in the casing member and adapted to be attached to a retractable unwinding tool and adapted to allow the retractable unwinding tool to automatically retract. In some embodiments, the automatic retracting mechanism is like ones that are commonly used for retractable measuring tapes, such as, for example, those disclosed in U.S. Pat. No. 3,713,603, or for retractable crowd control barriers, such as, for example, those disclosed in U.S. Pat. No. 4,844,420. Thus, in certain embodiments, the automatic retracting mechanism comprises a windup spring inside the casing member, with a resilient retractable unwinding tool attached to the spring extending through an opening in the casing member. A stationary device on the casing member provides a passage to admit an extended portion of the retractable unwinding tool laterally. The innermost end of the retractable unwinding tool is riveted or otherwise secured to the outermost end of a windup coil spring whose innermost end is sharply bent for retention in a slotted post integral with the casing member, and can be further retained in a spring anchor or the like. The slotted post can be further enclosed by end caps within the casing member. In certain embodiments, the casing member is rectangular, and can further have rounded edges. In certain embodiments, the casing member is made of molded plastic and is rectangular and can further have rounded edges, and further comprises a protrusion member of this invention, which can be any size, including about 0.5, 1, 1.5, or 2 inches long, molded together with each casing member at about the middle of the casing member. The protrusion member can comprise tape flag dispensers. In certain further embodiments, the protrusion member comprises 2 internal screw threads placed at each end of the protrusion member parallel to the casing member, each screw thread adapted to receive an individual writing instrument comprising an external screw thread. In certain other further embodiments, the protrusion member comprises 2 female or 2 male connectors placed at each end of the protrusion member parallel to the casing member, each female or male connector adapted to receive an individual writing instrument comprising a male or female connector that is adapted to be mated to the corresponding female or male connector on the protrusion member. In certain embodiments, the casing member is made of molded plastic. In some embodiments, the casing members are made of molded plastic and are rectangular. In certain embodiments, an outer second casing member, located laterally to the first casing member, is molded onto the first casing member. The outer second casing member can be made of molded plastic, and can be molded together with each of the first casing members. The outer second casing member can be cylindrical, partially cylindrical, the same or different length than the first casing member, and can be a clip. In yet certain further embodiments, each of these outer second casing members comprises 2 internal screw threads placed at about the midpoint of the outer second casing members, each screw thread adapted to receive an individual writing instrument comprising an external screw thread. In yet other further embodiments, each of these outer second casing members comprises 2 internal female connectors placed at about the midpoint of the outer second casing member, each female connector adapted to receive an individual writing instrument comprising a male connector that is adapted to be mated to the female connector. The female connector can also be on the individual writing instrument and the male connector being on the casing member. Any type of fasteners, or the like, as well as other means known in the art to join two such objects together, can be used that allows the outer second casing member to be adapted to receive an individual writing instrument so that the individual writing instrument is removably tethered to the outer second casing member, such as the friction fit mechanism detailed above, in which the friction material is made of thermoplastic elastomer ("TPE") and this rubber is injected over the hard plastic. The rubber can be in the form of a circle or a partial circle. The fit can be calibrated for optimal plug-in and removal effort. In certain embodiments, the outer second casing member is a clip that is adapted to receive one or more individual writing instruments.

In another aspect, this invention provides a multi-purpose combination writing instrument, which comprises a writing instrument holder as described herein, except that the two casing members are inside of the unwinding tool, which can be retractable or not, with the unwinding tool wrapping around the casing members.

In yet another aspect, this invention provides a multi-purpose combination writing instrument, which comprises a writing instrument holder as described herein, but without a retractable unwinding tool. In certain embodiments, this writing instrument holder comprises zero, one, or two casing members. In the case of two casing members, the casing members can be held together by, for example, two sets of locks, one on the top and one on the bottom of the two casing members, or they can be held together by, for example, magnets or glue, either on the tops and bottoms or on the sides of the casing members; the two casing members can be side by side (lateral to each other) or can be top to bottom. Any suitable locks, such as a male/female connector system, can be used. In certain embodiments, this multi-purpose combination writing instrument without a retractable unwinding tool comprises zero, one, or two casing members and a hinge assembly comprising a hinge assembled at around the middle of the holder, such that the multi-purpose combination writing instrument can be bent by means of the hinge. The hinge assembly is at about the middle of the casing members and separates each casing member into two halves. When bent in half, the multi-purpose combination writing instrument that comprises 4 individual writing instruments has two individual writing instruments on each half. The hinge assembly comprises means for allowing one to four individual writing instruments to be removably attached to the writing instrument holder. The hinge assembly can comprise internal screw threads, located, for example, parallel to the casing member(s), each screw thread adapted to receive an individual writing instrument comprising an external screw thread. As another example, the hinge assembly can comprise one or more internal female or male connectors, located, for example, parallel to the casing member(s), each female or male connector adapted to receive an individual writing instrument comprising a male or female connector that is adapted to be mated to the corresponding male or female connector on the hinge assembly. The hinge assembly can comprise two hinge assembly halves. The hinge assembly can comprise up to four such means for allowing individual writing instruments to be removably attached, two on either hinge assembly half with the other two facing the opposite side on the other hinge assembly half. In certain embodiments, this invention also provides a writing instrument holder having no casing members, comprising a hinge assembly, as detailed above, adapted to receive one or more individual writing instruments. The hinge assembly can comprise internal screw threads, located, for example, parallel to the individual writing instruments, each screw thread adapted to receive an individual writing instrument comprising an external screw thread. As another example, the hinge assembly can comprise one or more internal female or male connectors, located, for example, parallel to the individual writing instruments, each female or male connector adapted to receive an individual writing instrument comprising a male or female connector that is adapted to be mated to the female or male connector on the hinge assembly. Any form of hinges known in the art can be used. Examples of hinges are provided in U.S. Pat. Nos. 84,771 and 3,044,630. Briefly and as an example only, a hinge assembly comprises two hinge leaves and two hinge assembly halves; the hinge assembly also comprises three cylindrical knuckle portions (one hinge half and one hinge leaf having two knuckle portions and one hinge half and one hinge leaf having one), with two hinge pins inserted into the knuckle portions, the hinge pins and the knuckle portions together being able to freely pivot and to allow the hinge leaves to freely pivot. The hinge assembly can comprise the internal screw thread or the male or female connector discussed above. The hinge assembly can be made by any suitable material(s). In certain embodiments, one or more tape flag dispensers, which can contain round flags (any other shapes are also contemplated), are attached reversibly, by, for example, glue, to any suitable part of the multi-purpose combination writing instrument, such as, for example, the outside of the hinge assembly. In certain embodiments, the hinge assembly further comprises a set of assembly locks, to keep the writing instrument holder bent when the holder is bent. The hinge assembly also comprises a hinge with two hinge leaves, which comprises two hinge locks, one on each hinge leaf, adapted to lock the writing instrument holder in the erect position when the holder is erect. The hinge assembly and the casing member(s) are continuous (i.e., in one piece) and can be joined by any methods known in the art. The assembly locks and the hinge locks can be a set of locks with male and female connectors adapted to come together and serve as a locking mechanism. In certain embodiments, this writing instrument holder does not have a hinge and instead is conjoined by one or more sets magnets, such as one or two sets of magnets. In the case where the instrument holder does not have a hinge, the writing instrument comprises 1 or 2 casing members, which comprise means, same as those detailed herein (such as by friction fit), for allowing one to four individual writing instruments to be removably attached to the writing instrument holder. In another case where the instrument holder does not have a hinge, the writing instrument comprises 0, 1, or 2 casing members, which instrument holder also comprises means, same as those detailed herein (such as by friction fit), for allowing one to four individual writing instruments to be removably attached to the writing instrument holder.

This invention also provides one or two casing members that are hinged casing members as described above, which can optionally not comprise a hinge. This invention also provides a hinged writing instrument holder comprising zero, one, or two casing members, as described above, with or without a hinge.

In another aspect, this invention provides a multi-purpose combination writing instrument comprising a writing instrument holder comprising two casing members of this invention, detailed herein. This writing instrument holder is shaped like a hand-held fan with multiple leaves (i.e., unwinds and retracts like a hand-held fan with multiple leaves and looks like a hand-held fan with multiple leaves). The fan can be held in a closed position with a molded side hook or with a set of magnets at about the top position of the writing instrument. This multi-purpose writing instrument holder comprises a retractable unwinding tool that is shaped like a hand-held fan with one or multiple leaves (or slats), each leaf is shaped in the form of a leaf of a hand-held fan (other shapes are also contemplated), which can be flat and can be wider at the top and tapering and thus narrower at the bottom at the point where it inserts into a circular portion. Other suitable shapes are also contemplated. This retractable unwinding tool further comprises a circular portion and a pin. Each of the two casing members is also shaped in the form of a leaf of a hand-held fan with multiple leaves (other shapes are also contemplated), which can be flat and can be wider at the top and tapering and thus narrower at the bottom at the point where it inserts into the circular portion. Other suitable shapes are also contemplated. The leaves and the casing members are held together at the bottom by the circular portion with the pin to secure the casing members and the leaves. There can be one or more leaves, for example, 1, 2, 3, 4, 5, 6, 7, 8, 9, 10, or more leaves. Each of the multiple leaves (also known as slats) and the casing members can be of the same size, or not. The leaves and/or the casing members can be interconnected (partially or completely) by means known in the art, such as threads, etc., or not interconnected. In certain other embodiments, the leaves and/or the casing members have other suitable shapes (such as rectangular in shape) and can be flat or not. In certain further embodiments, each casing member comprises a protrusion member of this invention, located laterally and at around the middle of each casing member, distally from the retractable unwinding tool. Each protrusion member is adapted to receive 1-2 individual writing instruments. The fan can be any fan known in the art, such as, for example, the fans disclosed in U.S. Pat. No. 2,334,298 and D469,600. Briefly, the fan-shaped retractable unwinding tool can have individual leaves, which can be any number of leaves, such as, for example, between about 5-25 leaves. The leaves and the casing members are radially arranged when the fan-like retractable unwinding tool is open (i.e., not retracted). Each leaf and each casing member is terminated around a circular portion. The leaves and the casing members can pivot around the circular portion, for which purpose they can be secured together by a pin. The leaves and the casing members can be made by any suitable material(s), including bamboo, plastic and fabric. A design, as detailed above, can be displayed on the surface of one or both sides of the leaves, including a design on a piece of fabric that is placed over the surface of the leaves. The casing members can be shaped in the shape of the fan leaves (i.e., each casing member and each leaf shaped in the form of a leaf of a hand-held fan with multiple leaves, which is shaped wider at the top and tapering and thus narrower at the bottom at the point where it inserts into the circular portion). In certain embodiments, tape flag dispensers, which can contain round flags (tape flags of all possible shapes are contemplated), are attached reversibly, by, for example, glue, to the front, the back, or the outside of the protrusion member of a casing member facing distally from the other casing member. The leaves can be any suitable size and can be made of any suitable material, such as fabric, bamboo, plastic, etc. Likewise, the casing member can be any suitable size and can be made of any suitable material, such as fabric, bamboo, plastic, etc.

This invention also provides a method for writing using the multi-purpose combination writing instrument of this invention, comprising providing a multi-purpose combination writing instrument of this invention, and using the multi-purpose combination writing instrument of this invention to write, which method advantageously would not involve searching and fumbling for other individual writing instruments as the individual writing instruments would be available in one multi-purpose combination writing instrument of this invention.

This invention contemplates other items that can be removably attached to the "multi-purpose combination writing instrument holder," though the change in utility would also necessarily change the name of such a holder. For example, such items include: cosmetics such as lipsticks, eyeliners, and the like; sunscreen lotions; implements for shaving, such as shaving cream and shaving razor, etc. In the case of cosmetics, the retractable unwinding tool can have on its surface a mirror, which can be made of glass or plastic, or any material(s) that a mirror can be made of.

The multi-purpose combination writing instrument of this invention, the writing instrument holder of this invention, the individual writing instruments of this invention, and the casing members of this invention, and any part(s) thereof, can be made with any suitable material(s) by any known methods in the art, such as, for example, 3-D printing, injection molding, rapid prototyping, etc. Joining any two parts can be accomplished by any methods in the art using any suitable material(s). The multi-purpose combination writing instrument of this invention, the writing instrument holder of this invention, the individual writing instruments of this invention, and the casing members of this invention, and any part(s) thereof, can be of any suitable size and/or shape.

These and other embodiments of the invention are described below with reference to FIGS. 1-7 wherein like numerals are used throughout to denote like elements.

FIG. 1 illustrates exemplary embodiments of various aspects of this invention. FIG. 1 illustrates a multi-purpose combination writing instrument 100, comprising a writing instrument holder comprising two casing members 101 and 102 that are connected together laterally by a retractable unwinding tool 103 made of fabric, which tool is not retracted in this view. The two casing members, rectangular with rounded edges, face each other and are identical except they are in opposite orientation. The retractable unwinding tool 103 is adapted to fit inside the two casing members. Shown on casing member 102 is an opening 104 adapted to receive the retractable unwinding tool 103. The same opening (not shown) is present on casing member 101. The retractable unwinding tool 103 has two stoppers 105 and 106, symmetrically placed on the top and the bottom of the retractable unwinding tool 103, and a design 107, which can be a logo, on its surface. The logo can be any logo. The stoppers, which are symmetrical—one on the top and one on the bottom of the retractable unwinding tool 103—are adapted to keep the retractable unwinding tool 103 to enter disproportionately into the casing members 101 and 102 when retracted. There can be another design on the surface of the other side of the retractable unwinding tool 103. The casing member 101 has a protrusion member 108 laterally at about the middle of the casing member 101, located distally from the retractable unwinding tool 103. Two individual writing instruments 109 and 110 are removably attached to casing member 101. The individual writing instruments 109 and 110 are oriented opposite to each other, such that the "business ends"—the ends for, for example, writing, for erasing, for highlighting, are opposite to each other. The individual writing instruments 109 and 110 are retractable; the individual writing instrument 109 comprises a side knob 111 and the individual writing instrument 110 a side knob 112. The side knobs 111 and 112 are used for retracting the corresponding individual writing instrument. A pad of stickers 113 with tape flags are reversibly attached by, for example, glue, to the protrusion member 108 laterally on the outside of the protrusion member 108 distally from the retractable unwinding tool 103. The casing member 102 has a protrusion member 114 laterally at about the middle of casing member 102 distally from the retractable unwinding tool 103. The protrusion member 114 has internal screw thread 115, adapted to receive the individual writing instrument 116. Two individual writing instruments 116 and 117 are removably attachable to casing member 102. The individual writing instrument 116 has external screw thread 120 and individual writing instrument 117 has external screw thread 121, the internal screw threads being adapted to allow the individual writing instruments 116 and 117 to be removably attached to protrusion member 114 by fastening onto the internal screw threads (internal screw thread 115 is shown in one end of protrusion member 114; and likewise, internal screw thread, not shown, is also on the distal, opposite side of the protrusion member 114). The same system with internal screw threads inside of the protrusion member 114 and external screw threads on the individual writing instruments 116 and 117 is used on the other side (casing member 101, with protrusion member 108 and individual writing instruments 109 and 110). The individual writing instruments 116 and 117 are oriented opposite to each other, such that the "business ends"—the ends for, for example, writing, for erasing, for highlighting, are opposite to each other. The individual writing instruments 116 and 117 are retractable. The individual writing instrument 116 comprises a side knob 118 and the individual writing instrument 117 a side knob 119. The side knobs 118 and 119 are used for retracting the corresponding individual writing instrument. A pad of stickers 113 that are tape flags are reversibly attached to protrusion member 108; likewise, a pad of stickers (not shown) that are tape flags are reversibly attached to protrusion member 114. The casing member 102 has locks 122 and 123 on the top and the bottom respectively of casing member 102 and are located facing casing member 101. The casing member 101 has locks as well (not shown), symmetrically located at the same positions as those on casing member 102 but facing casing member 102 and are adapted to lock the two casing members 101 and 102 together when the retractable unwinding tool 103 is fully retracted by locking with the corresponding locks 122 and 123 on casing member 102. The writing instrument holder is the unit without the individual writing instruments.

Figure 2:
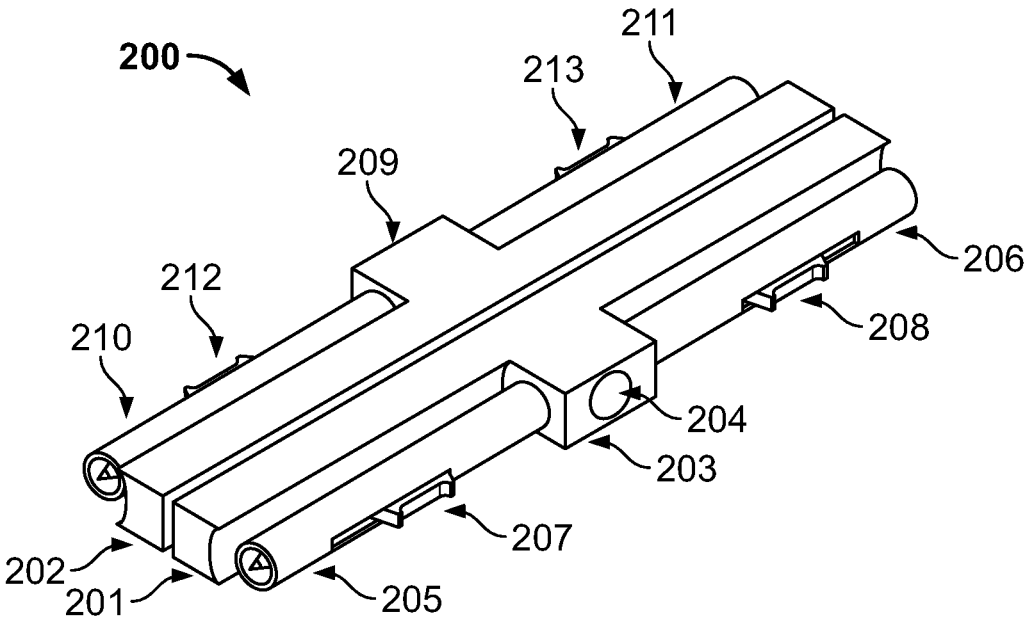
FIG. 2 is a second schematic view of the multi-purpose combination writing instrument of FIG. 1, comprising a writing instrument holder, which comprises two casing members, according to embodiments of the present invention.

FIG. 2 illustrates exemplary embodiments of various aspects of this invention. FIG. 2 is a view of the multi-purpose combination writing instrument illustrated in FIG. 1 but with the retractable unwinding tool fully retracted (and thus not shown). FIG. 2 illustrates a multi-purpose individual writing instrument 200, comprising a writing instrument holder comprising two casing members 201 and 202, rectangular with rounded edges, that are connected together laterally by a retractable unwinding tool made of fabric, which tool is retracted in this view and cannot be seen. The casing member 201 has a protrusion member 203 laterally at about the middle of casing member 201 distally from the retractable unwinding tool and casing member 202. A pad of stickers 204 that are tape flags are reversibly attached by, for example, glue, to protrusion member 203. Likewise, a pad of stickers (not shown) that are tape flags is also reversibly attached to protrusion member 209. Two individual writing instruments 205 and 206 are removably attached to casing member 201. The individual writing instruments 205 and 206 are oriented opposite to each other, such that the "business ends"—the ends for, for example, writing, for erasing, for highlighting, are opposite to each other. The individual writing instruments 205 and 206 are retractable; the individual writing instrument 205 comprises a side knob 207 and the individual writing instrument 206 a side knob 208. The side knobs are used for retracting the corresponding individual writing instrument. The casing member 202 has a protrusion member 209 laterally at about the middle of casing member 202 and placed distally from the casing member 201. Two individual writing instruments 210 and 211 are removably attached to casing member 202. The individual writing instruments 210 and 211 are oriented opposite to each other, such that the "business ends"—the ends for, for example, writing, for erasing, for highlighting, are opposite to each other. The individual writing instruments 210 and 211 are retractable; the individual writing instrument 210 comprises a side knob 212 and the individual writing instrument 211 a side knob 213. The side knobs are used for retracting the corresponding individual writing instrument. The writing instrument holder is the unit without the individual writing instruments.

Figure 3:
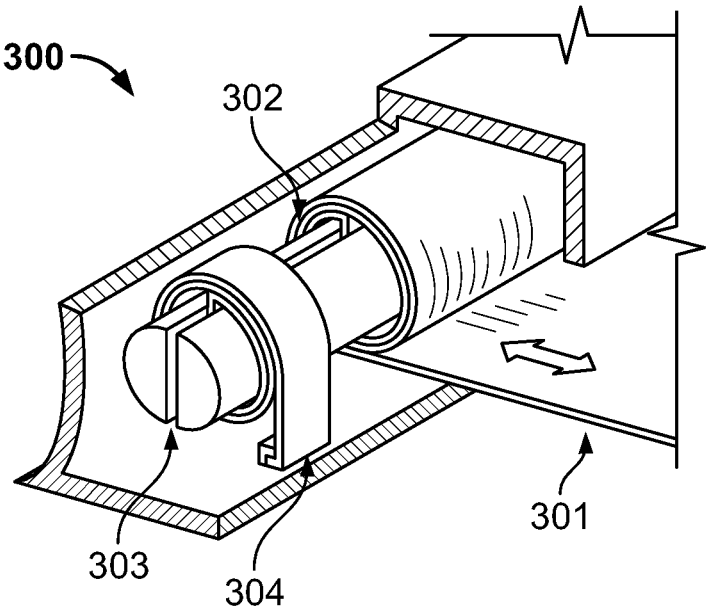
FIG. 3 is a schematic, blown-up view of an automatic retracting mechanism inside one end of a casing member, according to embodiments of the present invention.

FIG. 3 illustrates an exemplary embodiment of a casing member 300 with a retractable unwinding tool 301 connected to casing member 300 laterally and partially retracted. The retractable unwinding tool 301 is automatically retractable by an automatic retracting mechanism comprising a windup spring 302, a slotted post 303, and a spring anchor 304.

Figure 4:
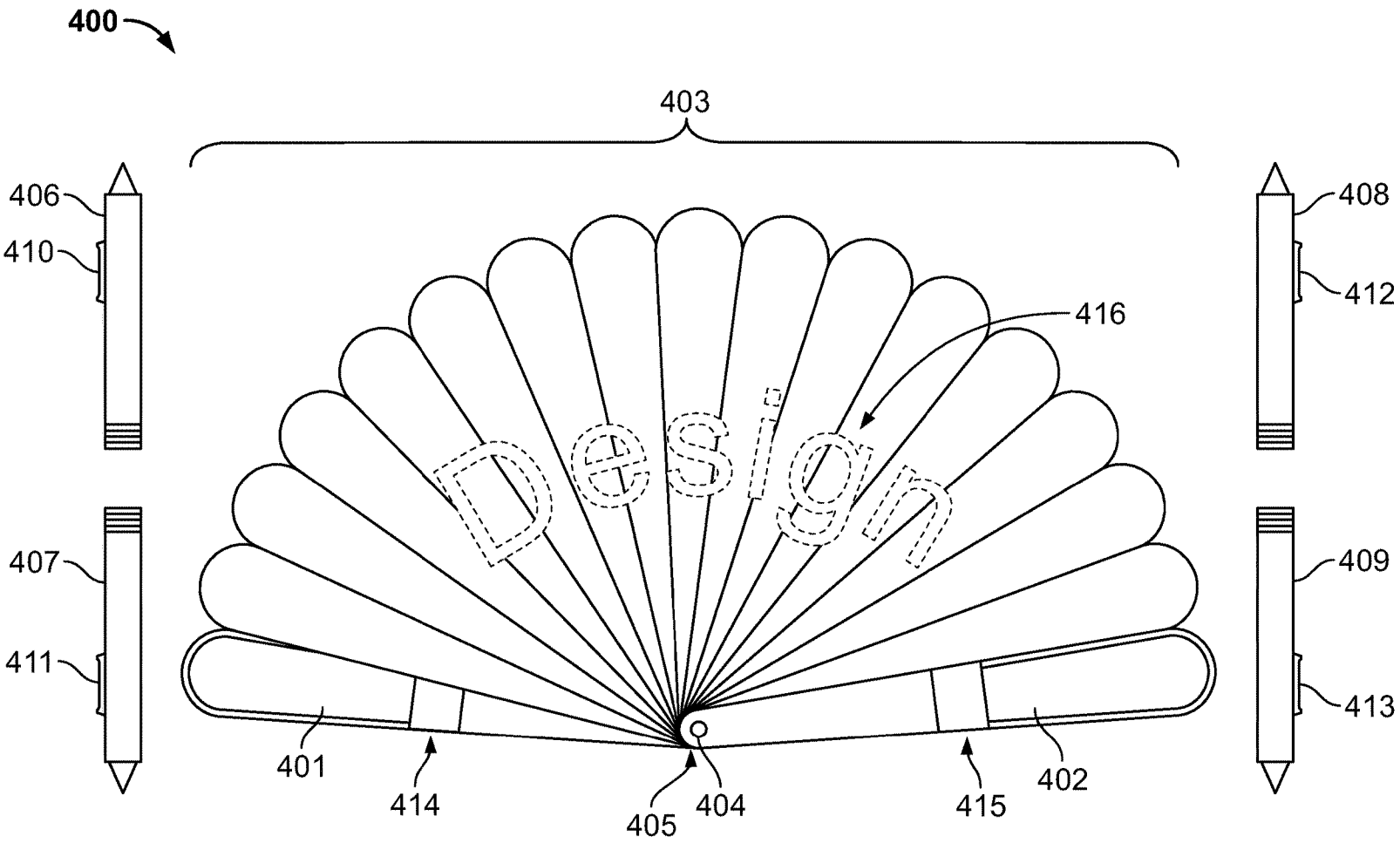
FIG. 4 is a schematic view of another multi-purpose combination writing instrument, comprising a fan-like writing instrument holder, which comprises two casing members connected laterally by a fan-like retractable unwinding tool, according to embodiments of the present invention.

FIG. 4 illustrates exemplary embodiments of various aspects of this invention. FIG. 4 illustrates a multi-purpose combination writing instrument 400, comprising a writing instrument holder comprising two casing members 401 and 402, each shaped in the form of a leaf of a hand-held fan with multiple leaves, which casing members 401 and 402 are connected together laterally by a number of individual leaves 403, each shaped in the form of a leaf of a hand-held fan with multiple leaves, which leaves can be made of fabric, bamboo, plastic, etc. Each casing member and each leaf is shaped in the form of a leaf of a hand-held fan with multiple leaves, wider at the top and tapering and thus narrower on the bottom at the point where it inserts into the circular portion, as shown in FIG. 4, 403, and each can be flat. The leaves 403 and/or the casing members 401 and 402 can be interconnected (partially or completely), or not interconnected. Each leaf is terminated around a circular portion 405 and a pin 404 secures the casing members and the leaves. The leaves and the casing members can rotate around circular portion 405. The writing instrument holder comprises a retractable unwinding tool which comprises the individual leaves 403, the circular portion 405 and the pin 404. The leaves 403 and the casing members 401 and 402 are radially arranged, as shown, when the fan-like retractable unwinding tool is not retracted (i.e., open) as shown here. Four individual writing instruments 406, 407, 408, and 409 of this invention can be removably attached to the casing members 401 and 402. These individual writing instruments 406, 407, 408, and 409 are removably attachable to casing member 401 and 402 and comprise side knobs 410, 411, 412, and 413. Casing member 401 comprises a protrusion member 414 and casing member 402 comprises a protrusion member 415; the protrusion members being adapted to receive the writing instruments 406, 407, 408, and 409. A design 416 is on the surface of the leaves 403. Another design can be displayed on the other side of the leaves 403. The writing instrument holder is the unit without the individual writing instruments.

Figure 5:
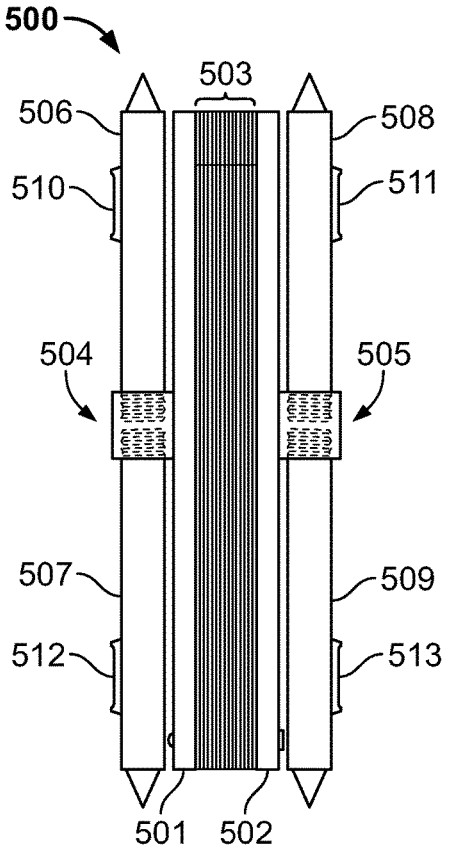
FIG. 5 is a second schematic view of the multi-purpose combination writing instrument of FIG. 4, comprising a writing instrument holder, which comprises two casing members connected laterally by a retractable unwinding tool, according to embodiments of the present invention.

FIG. 5 illustrates exemplary embodiments of various aspects of this invention. FIG. 5 illustrates a multi-purpose combination writing instrument 500, which are the exemplary embodiments disclosed in FIG. 4, except that in this view the fan-like retractable unwinding tool is retracted (i.e., closed). The instrument 500 comprises a writing instrument holder comprising two casing members 501 and 502 that are connected together laterally by a number of individual leaves 503, which can be made of fabric, bamboo, plastic, etc. Four individual writing instruments 506, 507, 508, and 509 of this invention can be removably attached to the casing members 501 and 502. In this view, the individual writing instruments 506, 507, 508, and 509 are attached to the casing members 501 and 502. These individual writing instruments 506, 507, 508, and 509 are removably attachable to casing member 501 and 502 (by being attached removably to the protrusion members 504 and 505) and comprise side knobs 510, 511, 512, and 513. Casing member 501 comprises a protrusion member 504 and casing member 502 comprises a protrusion member 505. The writing instrument holder is the unit without the individual writing instruments.

Figure 6:
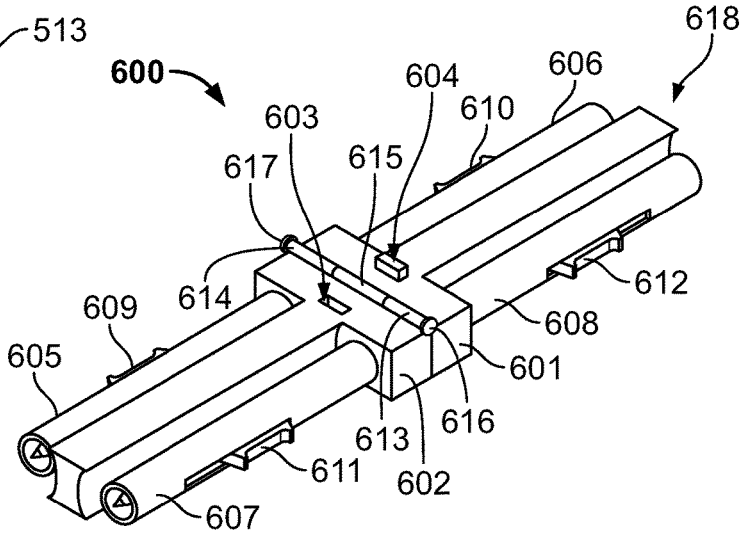
FIG. 6 is a schematic view of a multi-purpose combination writing instrument, comprising a writing instrument holder, which comprises a hinged casing member, according to embodiments of the present invention.

FIG. 6 illustrates exemplary embodiments of various aspects of this invention. FIG. 6 illustrates a multi-purpose combination writing instrument 600, comprising a writing instrument holder comprising either zero, one, or two casing members, with one casing member 618 being shown here in the embodiments displayed. A casing member 618 comprises a hinge assembly with two hinge assembly halves 601 and 602 at about the middle of the casing member 618. Each of the hinge assembly halves 601 and 602 has two internal threads, such that the hinge assembly halves 601 and 602 are adapted to receive the individual writing instruments 605, 606, 607, and 608. These individual writing instruments 605, 606, 607, and 608 are removably attached to casing member 618, tethered to the hinge assembly halves 601 and 602, and comprise side knobs 609, 610, 611, and 612. The hinge assembly half 601 comprises cylindrical knuckle portions 613 and 614 and the hinge assembly half 602 comprises cylindrical knuckle portion 615. Each hinge assembly half 601 and 602 comprises a cylindrical slot adapted to receive a hinge pin 616 and a hinge pin 617, respectively, the hinge pins 616 and 617 being inserted into the knuckle portions 613, 614, and 615. The hinge pins 616 and 617, together with the knuckle portions 613, 614, and 615 being able to freely pivot, allowing the hinge assembly to bend. The hinge assembly can comprise one or more flag dispensers. The hinge assembly comprises hinge assembly locks 603 (female connector) and 604 (male connector), adapted to lock the hinge assembly when the writing instrument holder is bent. The writing instrument holder is in the erect form here. This combination writing instrument 600 does not comprise a retractable unwinding tool. The writing instrument holder is the unit without the individual writing instruments.

Figure 7:
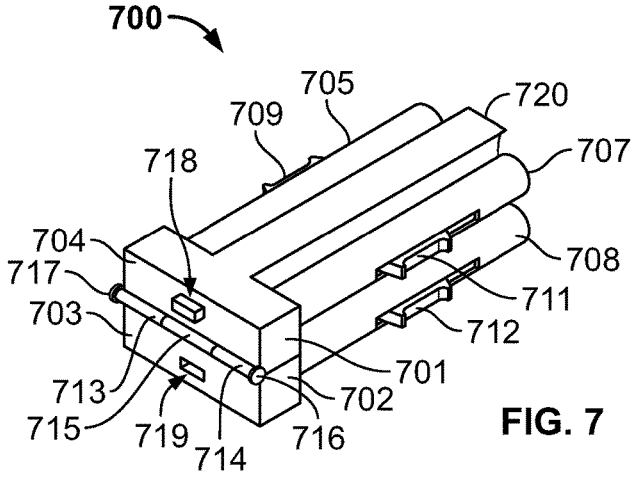
FIG. 7 is a second schematic view of the multi-purpose combination writing instrument of FIG. 6, comprising a writing instrument holder, which comprises a hinged casing member, according to embodiments of the present invention.

FIG. 7 illustrates exemplary embodiments of various aspects of this invention. FIG. 7 illustrates a multi-purpose combination writing instrument 700 of FIG. 6, in the position in which the hinge assembly is bent. FIG. 7 illustrates a multi-purpose combination writing instrument 700, comprising a writing instrument holder comprising zero, one, or two casing members, with one casing member 720 being shown here in the embodiments displayed. The casing member 720 comprises a hinge assembly with two hinge assembly halves 701 and 702 at about the middle of the casing member 720. The hinge assembly halves 701 and 702 comprise a hinge with two hinge leaves 703 and 704, which comprise hinge locks 718 (male connector) and 719 (female connector), adapted to lock the hinge when the writing instrument holder is erect. The hinge assembly halves 701 and 702 have four internal screw threads adapted to receive individual writing instruments 705, 706 (not shown), 707, and 708. These individual writing instruments 705, 706, 707, and 708 are removably attached to casing member 720 and comprise side knobs 709, 710 (not shown), 711, and 712. The hinge leaf 703 comprises two knuckle portions 713 and 714, and the hinge leaf 704 comprises one knuckle portion 715. Two hinge pins 716 and 717 are inserted into the cylindrical knuckle portions 713, 714, and 715. The hinge pins 716 and 717 and the knuckle portions 713, 714, and 715 together being able to freely pivot. The hinge assembly can comprise one or more flag dispensers. The writing instrument holder is in the bent form here. This combination writing instrument 700 does not comprise a retractable unwinding tool. The writing instrument holder is the unit without the individual writing instruments.

All patents, patent publications, and references mentioned herein are incorporated by reference.

The foregoing description discloses only exemplary embodiments of the invention. Modifications of the above disclosed multi-purpose combination writing instruments, writing instrument holders, individual writing instruments, casing members, and methods which fall within the scope of the invention will be readily apparent to those of ordinary skill in the art.

While only certain preferred features of the invention have been illustrated and described, many modifications and changes will occur to those skilled in the art. It is therefore, to be understood that the appended claims are intended to cover all such modifications and changes as fall within the true spirit of the invention.

While the present invention has been disclosed in connection with exemplary embodiments thereof, it should be understood that other embodiments may fall within the spirit and scope of the invention.

The invention claimed is:

1. A multi-purpose combination writing instrument comprising:

a writing instrument holder comprising two casing members connected together laterally by a retractable unwinding tool, wherein the casing members are outside of the retractable unwinding tool such that the retractable unwinding tool is inside of one or both of the casing members when retracted, each casing member comprising an opening adapted to receive the retractable unwinding tool and wherein the opening of each casing member faces each other and the retractable unwinding tool enters the casing member from the opening; and said multi-purpose combination writing instrument comprising one to four removable individual writing instruments attached to the casing members of the writing instrument holder, further comprising an automatic retracting mechanism inside each casing member, said automatic retracting mechanism adapted to automatically retract the retractable unwinding tool, said automatic retracting mechanism being attached to the retractable unwinding tool, such that when the retractable unwinding tool is retracted into the opening in one or both of the casing members, it is stored inside one or both of the casing members, wherein the retractable unwinding tool further comprises two stoppers located at around the middle of the retractable unwinding tool, one on the top of the retractable unwinding tool and one on the bottom of the retractable unwinding tool, said stoppers being adapted to ensure that the retractable unwinding tool does not retract disproportionately into the two casing members.

2. A multi-purpose combination writing instrument comprising:

a writing instrument holder comprising two casing members connected together laterally by a retractable unwinding tool, wherein the casing members are outside of the retractable unwinding tool such that the retractable unwinding tool is inside of one or both of the casing members when retracted, each casing member comprising an opening adapted to receive the retractable unwinding tool and wherein the opening of each casing member faces each other and the retractable unwinding tool enters the casing member from the opening; and said multi-purpose combination writing instrument comprising one to four removable individual writing instruments attached to the casing members of the writing instrument holder, wherein each casing member comprises a lock at the top and the bottom facing the other casing member, said locks adapted to lock the two casing members together when the retractable unwinding tool is retracted.

3. A multi-purpose combination writing instrument comprising:

a writing instrument holder comprising two casing members connected together laterally by a retractable unwinding tool, wherein the casing members are outside of the retractable unwinding tool such that the retractable unwinding tool is inside of one or both of the casing members when retracted, each casing member comprising an opening adapted to receive the retractable unwinding tool and wherein the opening of each casing member faces each other and the retractable unwinding tool enters the casing member from the opening; and said multi-purpose combination writing instrument comprising one to four removable individual writing instruments attached to the casing members of the writing instrument holder wherein the casing members are made of molded plastic and are rectangular with rounded edges from the top to the bottom of the rectangular casing members located on the outside of each casing member distally from the other casing member and distally from the retractable unwinding tool when the tool is not retracted, and a protrusion member between about 0.5 to about 2 inches long is molded together with each casing member at about the middle of the casing member facing distally from the retractable unwinding tool when the retractable unwinding tool is not retracted and distally from the other casing member and thus does not face the other casing member; wherein each of the one to four writing instruments is retractable and each of the one to four writing instruments comprises a side knob for retracting the individual writing instrument.

4. The multi-purpose combination writing instrument of claim 3, wherein each protrusion member further comprises 2 internal screw threads placed at each end of the protrusion member parallel to the casing member, each screw thread adapted to receive an individual writing instrument comprising an external screw thread, wherein each individual writing instrument is screwed into the protrusion member such that the individual writing instruments are in opposite orientation to each other, wherein the multi-purpose combination writing instrument comprises four individual writing instruments.

5. The multi-purpose combination writing instrument of claim 3, wherein each protrusion member further comprises 2 female connectors placed at each end of the protrusion member parallel to the casing member, each female connector adapted to receive an individual writing instrument comprising a male connector that is adapted to be mated to the female connector, wherein each individual writing instrument is connected to the protrusion member by the male/female connectors such that the individual writing instruments are in opposite orientation to each other, wherein the multi-purpose combination writing instrument comprises four individual writing instruments.

* * * * *